US007190765B2

(12) United States Patent
Wang et al.

(10) Patent No.: US 7,190,765 B2
(45) Date of Patent: Mar. 13, 2007

(54) BEARING TEMPERATURE AND FOCAL SPOT POSITION CONTROLLED ANODE FOR A CT SYSTEM

(75) Inventors: Liqin Wang, Brookfield, WI (US); Gregory A. Steinlage, Milwaukee, WI (US); David E. Dean, Hartland, WI (US); Thomas D. Schaefer, Milwaukee, WI (US)

(73) Assignee: General Electric Company, Schenectady, NY (US)

( * ) Notice: Subject to any disclaimer, the term of this patent is extended or adjusted under 35 U.S.C. 154(b) by 120 days.

(21) Appl. No.: 10/710,629

(22) Filed: Jul. 26, 2004

(65) Prior Publication Data

US 2006/0018433 A1 Jan. 26, 2006

(51) Int. Cl.
*H01J 35/10* (2006.01)

(52) U.S. Cl. ..... 378/142; 378/132

(58) Field of Classification Search ..... 378/132, 378/142

See application file for complete search history.

(56) References Cited

U.S. PATENT DOCUMENTS 3,855,492 A * 12/1974 Langer et al. ..... 378/125
3,956,653 A * 5/1976 Lauwasser ..... 378/128
4,504,965 A * 3/1985 Ebersberger ..... 378/132
5,699,401 A * 12/1997 Jackson et al. ..... 378/144
6,295,338 B1 * 9/2001 Kuzniar et al. ..... 378/132
6,445,770 B1 * 9/2002 Wandke et al. ..... 378/132
6,477,231 B2 * 11/2002 Snyder et al. ..... 378/130
6,477,236 B1 * 11/2002 Anno et al. ..... 378/144
6,480,571 B1 * 11/2002 Andrews ..... 378/131
6,553,097 B2 * 4/2003 Hansen et al. ..... 378/144
6,603,834 B1 * 8/2003 Lu et al. ..... 378/141
6,735,281 B2 * 5/2004 Higgins et al. ..... 378/132
2005/0243969 A1 * 11/2005 Andrews ..... 378/119

* cited by examiner

*Primary Examiner*—Edward J. Glick
*Assistant Examiner*—Thomas R. Artman
(74) *Attorney, Agent, or Firm*—Peter J. Vogel

(57) ABSTRACT

An anode assembly (50) includes a thermally conductive bearing encasement (52) covering a portion of a bearing (64). An anode (56) rotates on the bearing (64) and has a target (58) with an associated focal spot (60). The thermally conductive bearing encasement (52) is configured and expansion limited to prevent displacement of the focal spot (60) of greater than a predetermined displacement during operation of the anode (56).

17 Claims, 3 Drawing Sheets

BEARING TEMPERATURE AND FOCAL SPOT POSITION CONTROLLED ANODE FOR A CT SYSTEM

BACKGROUND OF INVENTION

The present invention relates generally to computed tomography (CT) imaging systems and more particularly, to a system for maintaining bearing temperatures of an anode as well as minimizing focal spot displacement due to thermal expansion of anode related components.

A CT imaging system typically includes a gantry that rotates at various speeds in order to create a 360° image. The gantry contains an x-ray source, such as an x-ray tube that generates x-rays across a vacuum gap between a cathode and an anode. The anode has a target that is coupled to a stem, which rotates on a pair of anode bearings. X-rays are emitted from the target and are projected in the form of a fan-shaped beam, which is collimated to lie within an X-Y plane of a Cartesian coordinate system, generally referred to as the "imaging plane". The x-ray beam passes through the object being imaged, such as a patient. The beam, after being attenuated by the object, impinges upon an array of radiation detectors. Each detector element of the array produces a separate electrical signal that is a measurement of the beam attenuation at the detector location. The attenuation measurements from all the detectors are acquired separately to produce a transmission profile for generation of an image.

It is desirable to increase gantry rotating speeds and CT tube peak operating power such that quicker imaging times and improved image quality can be provided. In order to do so certain requirements must be satisfied, such as the ability to operate the anode bearings within a wide range of the power spectrum, i.e. approximately 0–8 kw. However, the dry lubrication typically used in the bearings has an optimal operating temperature range of approximately 400° C.–550° C. Large fluctuations in power spectrum operation can result if the bearings are operated outside this temperature range.

Also, it is further required that focal spot displacement, in the anode axial direction, should be minimized during operation of a CT system. Thermal expansion of the stem and other anode related components, however, can cause the position of the target to change and thus the location of the focal spot to change. This focal spot displacement can negatively affect performance of a CT system.

Current anode designs are unable to satisfy the above-described requirements. Thus, there exists a need for an improved CT system that maintains bearing operating temperature of an anode within a desired operating range and minimizes focal spot displacement of that anode.

SUMMARY OF INVENTION

The present invention provides an anode assembly for a computed tomography (CT) system. The anode assembly includes a thermally conductive bearing encasement covering a portion of a bearing. An anode rotates on the bearing and has a target with an associated focal spot. The thermally conductive bearing encasement is configured and expansion is limited to prevent displacement of the focal spot greater than a predetermined displacement during operation of the anode.

The embodiments of the present invention provide several advantages. One such advantage is the provision of a thermally conductive bearing encasement that is thermally conductive and expansion limited to allow thermal energy transfer therethrough and minimize anode focal spot displacement. The bearing encasement aids in maintaining bearing operating temperature to be within a desired temperature range.

Another advantage provided by an embodiment of the present invention, is the provision of a heat shield that has a predetermined height to allow thermal energy transfer between an anode and a set of bearings of an anode assembly as well as temperature continuity between bearings.

Yet another advantage provided by an embodiment of the present invention, is the provision of a heat shield that has multiple holes for the transfer of thermal energy between an anode and a set of bearings of an anode assembly.

The above stated advantages allow for the control of rotating anode bearing temperatures and focal spot displacement during operation of a CT system. This capability allows for increased gantry rotating speeds and the satisfaction of increased CT tube peak power requirements.

The present invention itself, together with attendant advantages, will be best understood by reference to the following detailed description, taken in conjunction with the accompanying figures.

BRIEF DESCRIPTION OF DRAWINGS

For a more complete understanding of this invention reference should now be had to the embodiments illustrated in greater detail in the accompanying figures and described below by way of examples of the invention wherein.

DETAILED DESCRIPTION

Figure 1:
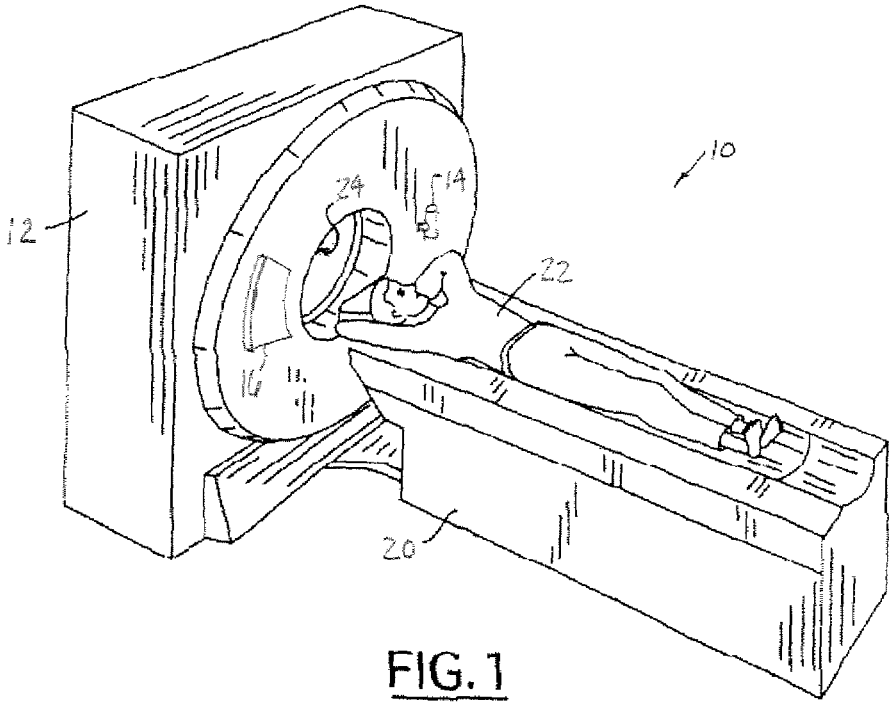
FIG. 1 is a perspective view of a CT imaging system in accordance with an embodiment of the present invention.

In the following figures the same reference numerals will be used to refer to the same components. While the present invention is described with respect to maintaining bearing temperatures of an anode as well as minimizing focal spot displacement due to thermal expansion of anode related components, the present invention may be adapted and applied to various systems and components of a CT or x-ray system.

In the following description, various operating parameters and components are described for one constructed embodiment. These specific parameters and components are included as examples and are not meant to be limiting.

Figure 2:
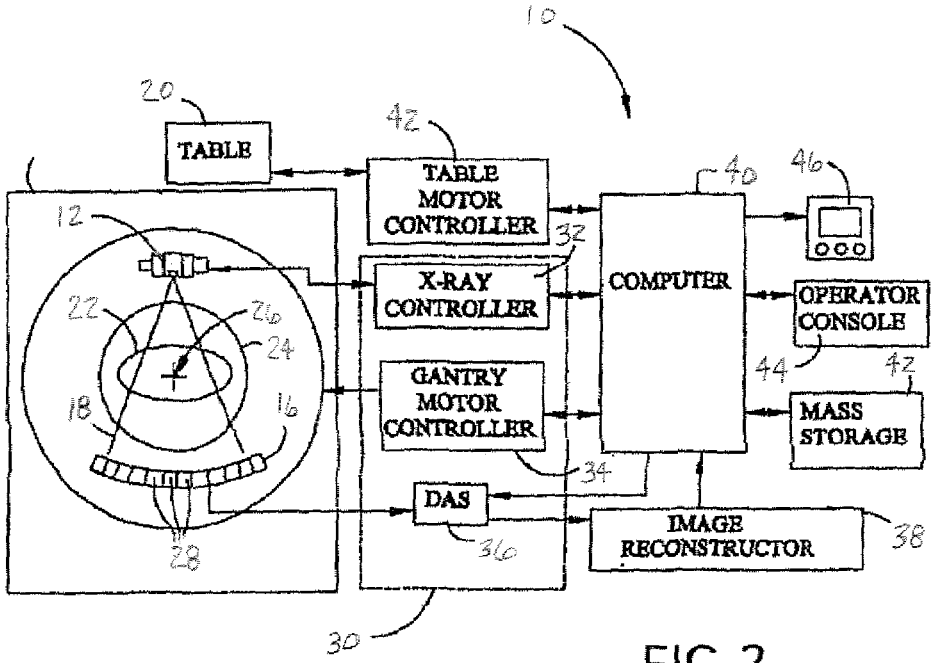
FIG. 2 is a schematic block diagrammatic view of the CT imaging system in accordance with an embodiment of the present invention.

Referring now to FIGS. 1 and 2, perspective and schematic block diagrammatic views of a CT imaging system 10 in accordance with an embodiment of the present invention are shown. The imaging system 10 includes a gantry 12 that has an x-ray source or x-ray tube assembly 14 and a detector array 16. The tube assembly 14 projects a beam of x-rays 18 towards the detector array 16. The tube assembly 14 and the detector array 16 rotate about an operably translatable table 20. The table 20 is translated along a z-axis between the tube assembly 14 and the detector array 16 to perform a helical scan. The beam 18 after passing through the medical patient 22, within the patient bore 24, is detected at the detector array 16. The detector array 16 upon receiving the beam 18 generates projection data that is used to create a CT image.

The tube assembly 14 and the detector array 16 rotate about a center axis 26. The beam 18 is received by multiple detector elements 28. Each detector element 28 generates an electrical signal that corresponds to the intensity of the impinging x-ray beam 18. As the beam 18 passes through the patient 22 the beam 18 is attenuated. Rotation of the gantry 12 and the operation of tube 14 are governed by a control mechanism 30. The control mechanism 30 includes an x-ray controller 32 that provides power and timing signals to the tube 14 and a gantry motor controller 34 that controls the rotational speed and position of the gantry 12. A data acquisition system (DAS) 36 samples the analog data, generated from the detector elements 28, and converts the analog data into digital signals for the subsequent processing thereof. An image reconstructor 38 receives the sampled and digitized x-ray data from the DAS 36 and performs high-speed image reconstruction to generate the CT image. A main controller or computer 40 stores the CT image in a mass storage device 42.

The computer 40 also receives commands and scanning parameters from an operator via an operator console 44. A display 46 allows the operator to observe the reconstructed image and other data from the computer 40. The operator supplied commands and parameters are used by the computer 40 in operation of the control mechanism 30. In addition, the computer 40 operates a table motor controller 42, which translates the table 20 to position the patient 22 in the gantry 12.

Figure 3:
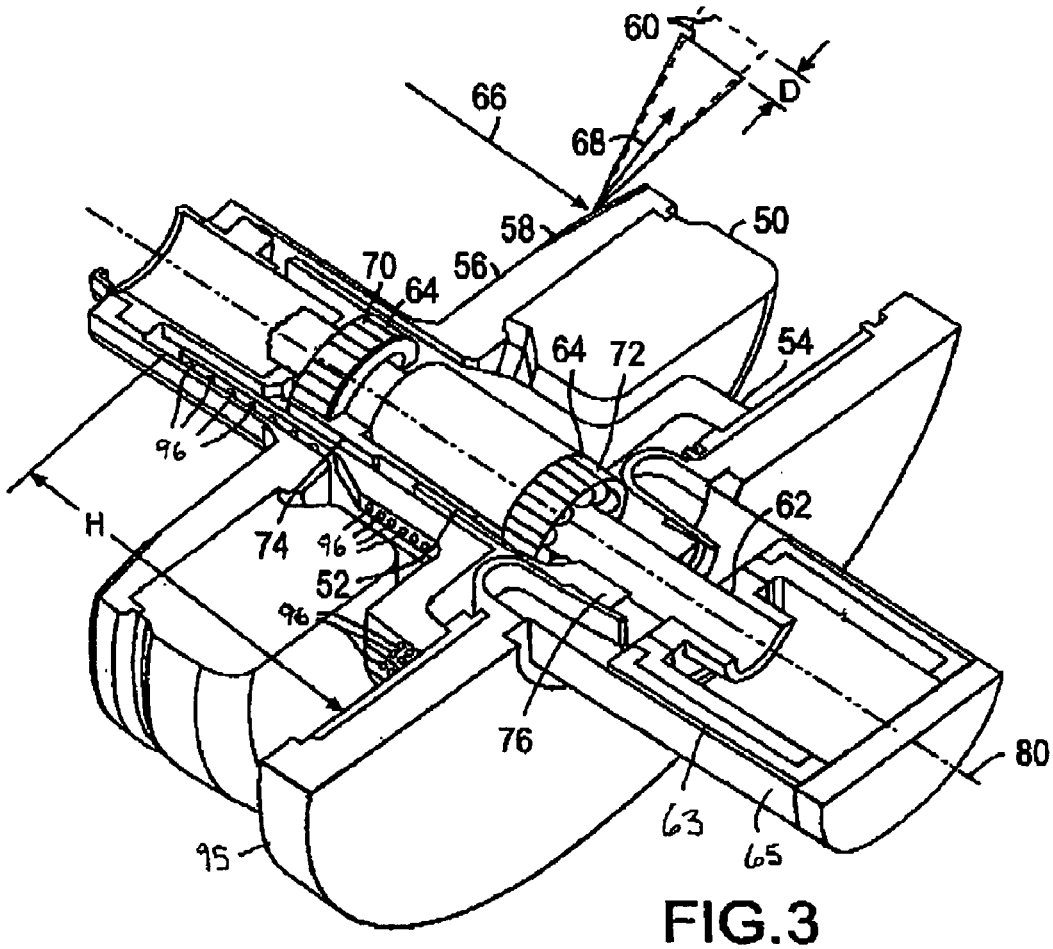
FIG. 3 is a cross-sectional perspective view of an anode assembly incorporating a bearing encasement and heat shield in accordance with an embodiment of the present invention.

Referring now to FIG. 3, a cross-sectional perspective view of an anode assembly 50 that incorporates a bearing encasement 52 and a heat shield 54 in accordance with an embodiment of the present invention is shown. The anode assembly 50 includes a rotating anode 56 having a target 58 with an associated focal spot 60. The anode 56 rotates on and with a bearing shaft 62 via a pair of bearing sets 64. The bearing shaft 62 is attached to a rotor 63 that rotates within a can 65. A stator (not shown) slides over the can 65 and is used in rotation of the rotor 63. The heat shield 54 resides between the anode 56 and the bearings 64. The bearing encasement 52 and the heat shield 54 are stationary and maintain operating temperature of the bearings 64 and are thermally expansion limited. The bearing encasement 52 and the heat shield 54 in maintaining operating temperature of the bearings 64 prevent thermal expansion of other anode related components within the anode assembly. Prevention of thermal expansion of anode assembly components prevents displacement of the focal spot. Impinging electrons 66, resultant emitted x-rays 68, and a sample focal spot displacement D are shown. The focal spot displacement D is not shown to scale, may vary in size depending upon the application, and is minimized in size by the bearing encasement 52.

The bearing encasement 52 encases a front set of bearings 70 and a rear set of bearings 72. The bearing encasement 52 includes a bearing housing 74 and a stem 76. The housing 74 contains the front bearings 70 and the stem 76 contains the rear bearings 72. The stem 76 may overlap the housing 74 as shown. The housing 74 and the stem 76 may be in the form of a single integral unit or may be separate components, as shown. The bearings 64 may have a dry lubrication applied to them, such as a graphite-based lubricant. In one embodiment of the present invention, the lubrication utilized has a desired temperature operating range of 400–550° C.

The bearing encasement 52 is formed of one or more control expansion alloys depending upon the application. Examples of some control expansion alloys are 36 alloy, 39 alloy, 42 alloy, 45 alloy, 49 alloy, Invar 36® Alloy, Kovar® Alloy, Ceramvar® Alloy, and Inco® 909. These alloys have varying percentages of iron, nickel, and cobalt content. Table 1 provides thermal conductivity, yield strength, and elastic modulus values for some of the abovementioned alloys. Table 1 also provides thermal conductivity, yield strength, and elastic modulus values for a typical Glidcop® or dispersion strengthened copper. "Glidcop®" is a trademark of OMG America. A Glidcop® or Glidcop® material is commonly formed of copper having an aluminum oxide dispersant and does not provide the thermal conductivity and expansion characteristics desired.

TABLE 1

Control Expansion Alloy Characteristic Values

| | 36 Alloy | 39 Alloy | 42 Alloy | 49 Alloy | Kovar ® Alloy | Inco ® 909 | Glidcop ® |
|---|---|---|---|---|---|---|---|
| Thermal Conductivity (Btu-in/hr-sq ft-deg F.) | 72.6 | 73.5 | 74.5 | 90 | 130.3 | 137.3 | 1872 |
| Yield Strength (ksi) | 40 | 40 | 40 | 40 | 32.6 | 139.2 | 75 |
| Elastic Modulus ($10^6$ psi) | 20.5 | 21 | 21 | 24 | 22.9 | 23.8 | 18.8 |

When forming the bearing encasement 52 the control expansion alloys are selected based on the application of interest. Desired bearing temperature operating range and maximum allowable focal spot displacement are also considered. The control expansion alloys are selected to prevent focal spot displacement of greater than a predetermined displacement. In one embodiment of the present invention, the maximum focal spot displacement or the predetermined displacement is approximately 700 μm. In the stated embodiment, control expansion alloys are selected to prevent anode assembly components from thermally expanding to such an extent that causes the focal spot to displace more than 700 μm from an initial position. When a smaller amount of thermal energy transfer and a lower amount of focal spot displacement is desired a higher volume of 36 Alloy may be used over that of the 49 Alloy.

Figure 4:
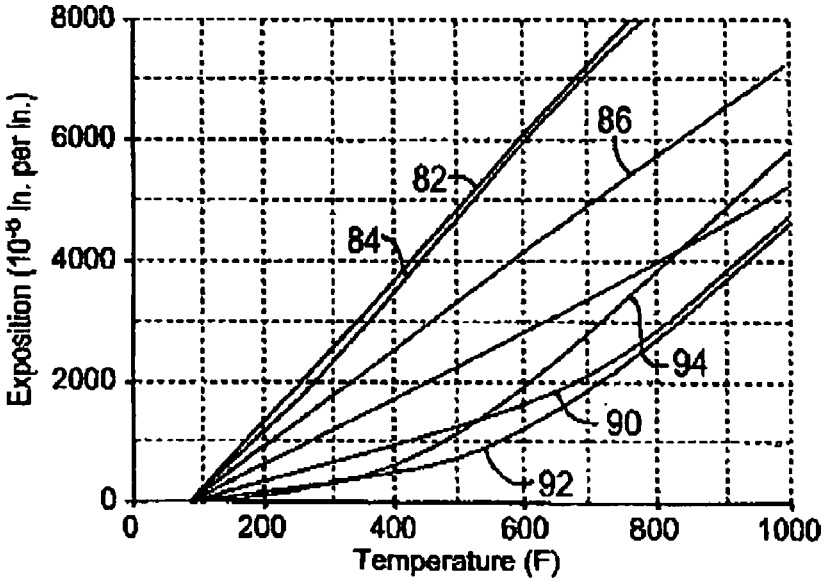
FIG. 4 is a graph of expansion versus temperature for multiple control expansion alloys.

The control expansion alloys prevent the bearing encasement 52 from thermally expanding along with the anode 56 in a forward direction longitudinally along a center axis 80 of rotation of the anode assembly 50. A plot of thermal expansion versus temperature for a high expansion alloy 22-3, a high expansion alloy 12-4, a low carbon steel, a 49% nickel alloy, a 42% nickel alloy, a 39% nickel alloy, and a 36% nickel alloy is shown in FIG. 4 and designated by numerals 82, 84, 86, 88, 90, 92, and 94, respectively. Note that in general the smaller amount or percentage of nickel contained within a material the smaller the amount of thermal expansion of that material.

Figure 5:
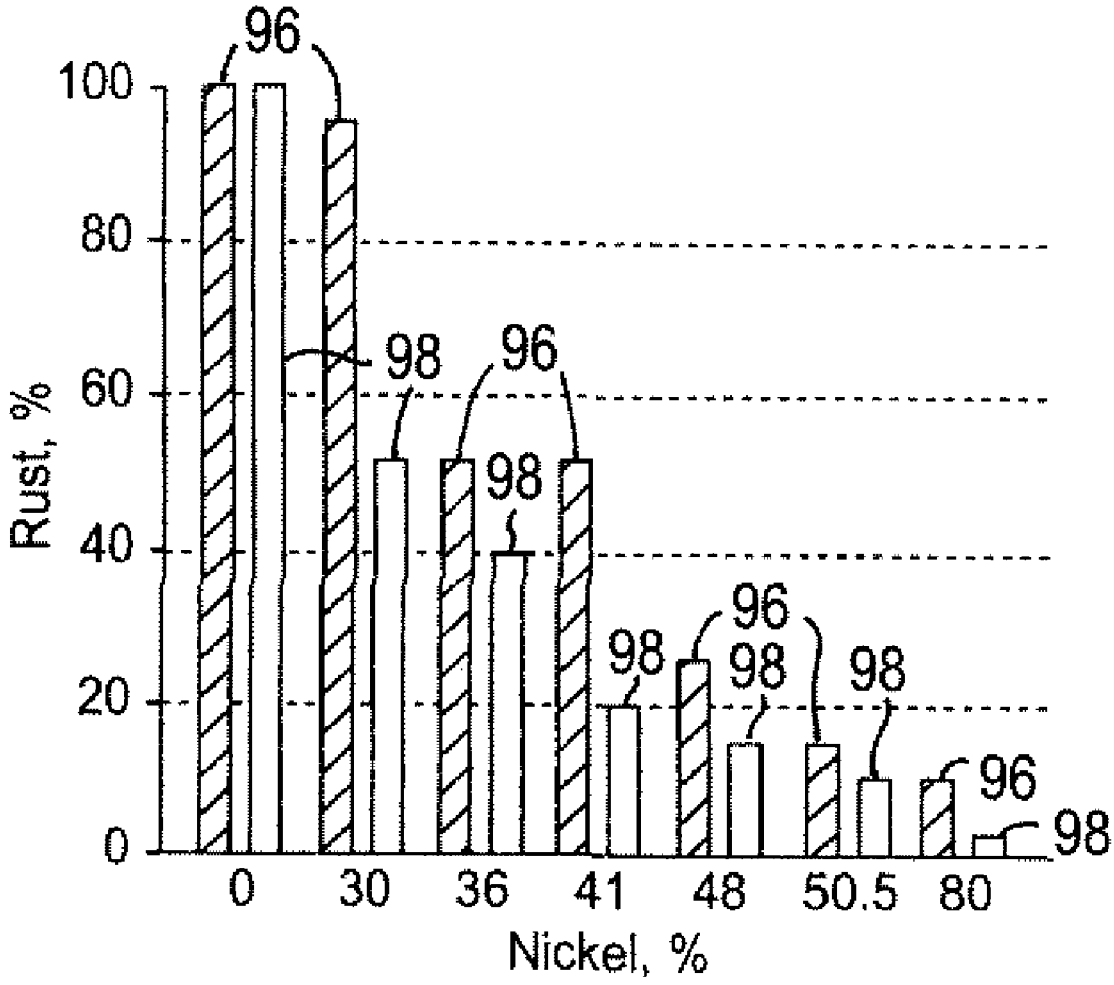
FIG. 5 is a graph of rust percentage versus nickel percentage for annealed and cold worked control expansion alloys.

In selecting alloys for use in the bearing encasement 52, although the lower the percentage of nickel the less the thermal expansion of the material, the lower the percentage of nickel the higher the percentage or chance for rust, as is shown in the bar graphs of FIG. 5. Hatched bars 96 represent annealed materials and solid bars 98 represent cold worked materials. Rust percentages for annealed and cold worked materials containing 0%, 30%, 36%, 41%, 48%, 50.5%, and 80% nickel are shown. Since rust can cause degradation of system components and can result in a poorly operating or inoperable component, it is desirable to minimize the amount of potential rust. Thus, several of the embodiments of the present invention utilize alloys having nickel percentages between 36 and 49, which provide low expansion characteristics and mild to low levels of rust.

Thus, alloys are selected for use in the bearing encasement 52 in response to maximum focal spot displacement, bearing operating temperature, material thermal conductivity, elastic modulus, and desired rust levels. Alloy selection may also be performed in response to other anode assembly and material characteristics known in the art.

Referring again to FIG. 3, the heat shield is coupled to a stationary backing plate 95. Although the heat shield 54 prevents thermal energy transfer between the anode 56 and the bearings 64, the heat shield 54 may have a height H that is less than a predetermined height for thermal energy passage between the anode 56 and the bearings 64 to a certain extent. The thermal energy passage may occur for temperatures that are greater than a predetermined threshold. The height H may be determined using thermal modeling techniques known in the art. As the height H is adjusted the heat shield 54 remains attached to the backing plate 95. In having the height H less than a predetermined height, the heat shield 54 provides temperature continuity between the bearings 64. The front bearings 70 are able to Increase to a temperature that is approximately the same as that of the rear bearings 72, which provides rotational uniformity of the anode 56 on the shaft 62.

The heat shield 54 may also have any number of thermal energy transfer holes 96. The holes 96 also allow for thermal energy transfer between the anode 56 and the bearings 64. Depending upon the configuration of the holes 96 a greater amount of thermal energy may be directed towards the front bearing 70 or the rear bearing 72. The holes 96 may be of various size and shape and may be in various configurations across the heat shield 54.

The present invention provides an anode assembly with a system for controlling the temperature of the bearings therein. The assembly prevents the displacement of the focal spot of the anode assembly and allows for thermal energy transfer between the anode and the bearings. This anode assembly allows for increased gantry operating speed and increased x-ray source power requirements and maintains bearing operating temperature to be within a desired temperature range.

While the invention has been described in connection with one or more embodiments, it is to be understood that the specific mechanisms and techniques which have been described are merely illustrative of the principles of the invention, numerous modifications may be made to the methods and apparatus described without departing from the spirit and scope of the invention as defined by the appended claims

The invention claimed is:

1. An anode assembly comprising:

a thermally conductive bearing encasement covering at least a portion of at least one bearing;

an anode rotating on said at least one bearing and having a target with an associated focal spot, which is displacement sensitive in response to expansion of said thermally conductive bearing encasement; and a heat shield preventing thermal energy transfer between said anode and said bearings, wherein height of said heat shield is set for temperature continuity between bearings of said at least one bearing; wherein said heat shield comprises at least one hole that extends radially, relative to an axis of rotation of said anode, to allow thermal energy transfer between the anode and said at least one bearing;

said thermally conductive bearing encasement preventing anode expansion and displacement of said focal spot of greater than a predetermined displacement.

2. An assembly as in claim 1 wherein said thermally conductive bearing encasement comprises a thermally conductive stem.

3. An assembly as in claim 2 wherein said thermally conductive stem is formed of at least one control expansion alloy.

4. An assembly as in claim 2 wherein said thermally conductive stein is formed of a combination of a plurality of materials selected from iron, nickel, and cobalt.

5. An assembly as in claim 1 wherein said thermally conductive bearing encasement comprises a thermally conductive housing.

6. An assembly as in claim 5 wherein said thermally conductive housing is formed of at least one control expansion alloy.

7. An assembly as in claim 5 wherein said thermally conductive housing is formed of a combination of a plurality of materials selected from iron, nickel, and cobalt.

8. An assembly as in claim 1 wherein height of said heat shield is less than a predetermined height for thermal energy passage between said anode and said at least one bearing of greater than a predetermined threshold.

9. An assembly as in claim 1 wherein said thermally conductive bearing encasement and said heat shield maintain operating temperatures of said at least one bearing to be within a predetermined operating range.

10. An assembly as in claim 9 wherein said predetermined operating range is approximately 400° C. to 550° C.

11. An assembly as in claim 1 wherein said thermally conductive bearing encasement prevents displacement of said focal spot in a forward direction along a longitudinal center axis of rotation of said anode.

12. An x-ray source comprising:

a cathode emitting electrons;

a thermally conductive bearing encasement comprising at least one alloy material and covering at least a portion of at least one bearing;

an anode rotating on and around said at least one bearing and having a target whereupon said electrons impinge to generate x-rays with an associated focal spot; and a thermal shield residing axially and between said thermally conductive bearing encasement and said anode along an axis of rotation, wherein said thermal shield comprises at least one hole, for the transfer of thermal energy, that extend radially inward from said anode to said at least one bearing;

said thermally conductive bearing encasement and said thermal shield preventing displacement of said focal spot.

13. An x-ray source as in claim 12 wherein height of said heat shield is determined for temperature continuity between bearings of said at least one bearing.

14. An imaging system comprising:

an x-ray source comprising;

a cathode emitting electrons;

a thermally conductive bearing encasement comprising at least one alloy material and covering at least a portion of at least one bearing;

an anode rotating on and covering said at least one bearing and having a target whereupon said electrons impinge to generate x-rays with an associated focal spot; and a thermal shield residing and extending longitudinally between said thermally conductive bearing encasement and said anode along an axis of rotation;

wherein said heat shield comprises a least one hole for the transfer of thermal energy that extend radially inward towards said axis of rotation and facilitates temperature continuity between front bearings and rear bearings of said at least one bearing.

15. A method of forming a thermally conductive bearing encasement for an anode assembly comprising:

determining a maximum focal spot displacement associated with a target of the anode assembly;

determining a desired elastic modulus of at least one control alloy expansion material for the thermally conductive bearing encasement in response to said maximum focal spot displacement;

determining a desired thermal conductivity of said at least one control alloy expansion material;

determining said at least one control alloy expansion material in response to said elastic modulus and said thermal conductivity; and forming the thermally conductive bearing encasement at least partially from said at least one control alloy expansion material.

16. A method as in claim 15 further comprising:

determining a desired level of rust for the thermally conductive bearing encasement; and determining said at least one control alloy expansion material in response to said level of rust.

17. A method as in claim 15 further comprising:

determining an anode bearing temperature operating range; and determining said at least one control alloy expansion material in response to said anode bearing temperature operating range.

* * * * *